US009384706B2

(12) United States Patent
Choi et al.

(10) Patent No.: US 9,384,706 B2
(45) Date of Patent: Jul. 5, 2016

(54) VOLTAGE GENERATING CIRCUIT HAVING A DISCHARGE PART AND DISPLAY APPARATUS HAVING THE VOLTAGE GENERATING CIRCUIT

(71) Applicant: Samsung Display Co., LTD., Yongin, Gyeonggi-Do (KR)

(72) Inventors: Hyong-Do Choi, Yongin-si (KR); Yun-Nam Kim, Suwon-si (KR); Sang-Young Lee, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 105 days.

(21) Appl. No.: 14/258,925

(22) Filed: Apr. 22, 2014

(65) Prior Publication Data

US 2015/0170596 A1 Jun. 18, 2015

(30) Foreign Application Priority Data

Dec. 17, 2013 (KR) ..... 10-2013-0157122

(51) Int. Cl.
*G09F 5/00* (2006.01)
*G09G 3/36* (2006.01)

(52) U.S. Cl.
CPC ..... *G09G 3/3696* (2013.01); *G09G 3/3611* (2013.01); *G09G 2310/0291* (2013.01)

(58) Field of Classification Search
CPC ..... G09G 3/3696; G09G 3/3611
USPC ..... 345/211
See application file for complete search history.

(56) References Cited

U.S. PATENT DOCUMENTS 7,791,579 B2 * 9/2010 Choi ..... G09G 3/3611 345/213
8,115,758 B2 2/2012 Iwabuchi et al.
8,154,267 B2 4/2012 Noda
2006/0050037 A1 3/2006 Maki
2007/0115274 A1 * 5/2007 Shih ..... G09G 3/3655 345/211
2008/0122824 A1 * 5/2008 Lee ..... G09G 3/3696 345/211
2011/0032236 A1 * 2/2011 Suzuki ..... G09G 3/3611 345/211
2011/0193844 A1 * 8/2011 Lee ..... G09G 3/3648 345/211
2012/0032938 A1 * 2/2012 Park ..... G09G 3/3208 345/211
2012/0127213 A1 * 5/2012 Park ..... G09G 3/3696 345/212

FOREIGN PATENT DOCUMENTS

JP 08-069329 3/1996
JP 2008-071218 3/2008
KR 10-0159536 8/1998
KR 10-2008-0069438 7/2008

* cited by examiner

*Primary Examiner* — Adam J Snyder
(74) *Attorney, Agent, or Firm* — Innovation Counsel LLP

(57) ABSTRACT

A voltage generating circuit includes a voltage dividing part connected between a main voltage source and a ground configured to divide a main voltage into a plurality of driving voltages and output the plurality of driving voltages, a delay part connected between a driving voltage source and the ground, and configured to delay a driving voltage by a predetermined period and apply the driving voltage to an input terminal of a driver circuit, and a discharge part connected between the voltage dividing part and the delay part, and configured to discharge a voltage charged in the delay part to a ground when the driving voltage is blocked. The discharge part comprises an amplifier, an inverting input of the amplifier being connected to the driving voltage source and a non-inverting input of the amplifier being connected to an output terminal of the delay part.

20 Claims, 6 Drawing Sheets

VOLTAGE GENERATING CIRCUIT HAVING A DISCHARGE PART AND DISPLAY APPARATUS HAVING THE VOLTAGE GENERATING CIRCUIT

This application claims priority to and the benefit of Korean Patent Application No. 10-2013-0157122 filed on Dec. 17, 2013, the entire contents of which are incorporated herein by reference.

BACKGROUND OF THE INVENTION

1. Field of the Invention

Exemplary embodiments of the inventive concept relate to a voltage generating circuit and a display apparatus having the voltage generating circuit. More particularly, exemplary embodiments of the inventive concept relate to a voltage generating circuit for providing a high reliability and a display apparatus having the voltage generating circuit.

2. Description of the Related Art

In general, a display apparatus includes a liquid crystal ("LC") display panel and a plurality of driver circuits which drives the LC display panel.

The LC display panel includes a plurality of gate lines, a plurality of data lines and a plurality of pixels. The driver circuits include a gate driver circuit which drives the gate lines and a data driver circuit which drives the data lines. In addition, the driver circuits include a voltage generating circuit which generates a plurality of driving voltages to drive the driver circuits.

When an external voltage is applied to the display apparatus, the display apparatus become a turn-on state. The external voltage is applied to the voltage generating circuit, the voltage generating circuit generates the driving voltages using the external voltage, and then the driving voltages are applied to the driver circuits. Thus, the display apparatus may be operated.

However, when the external voltage is blocked, the driving voltages are not supplied to the driver circuits and then the display apparatus become a turn-off state. When the display apparatus is in the turn-off state, a charged voltage in the driver circuits needs to be discharged quickly in order that the driver circuits can be driven normally when the display apparatus is turned on again subsequently. When the charged voltage in the driver circuits does not entirely discharge in the turn-off state, a false operation of the driver circuits occur.

BRIEF SUMMARY OF THE INVENTION

Exemplary embodiments of the inventive concept provide a voltage generating circuit having a self-discharge function.

Exemplary embodiments of the inventive concept provide a display apparatus having the voltage generating circuit.

According to an exemplary embodiment of the invention, there is provided a voltage generating circuit. The voltage generating circuit includes a voltage dividing part connected between a main voltage source and a ground, and configured to divide a main voltage into a plurality of driving voltages and output the plurality of driving voltages, a delay part connected between a driving voltage source and the ground, and configured to delay a driving voltage by a predetermined period and apply the driving voltage to an input terminal of a driver circuit, and a discharge part connected between the voltage dividing part and the delay part, and configured to discharge a voltage charged in the delay part to a ground when the driving voltage is blocked. The discharge part may include an amplifier, an inverting input of the amplifier being connected to the driving voltage source and a non-inverting input of the amplifier being connected to an output terminal of the delay part.

In an exemplary embodiment, the discharge part may further include a transistor which comprises a control electrode connected to an output terminal of the amplifier to output an output signal of the amplifier, a first electrode connected to the output terminal of the delay part and a second electrode connected to the ground.

The discharge part further includes a resistor connected between the output terminal of the amplifier and the control terminal of the transistor.

The output terminal of the delay part may be connected to a reset terminal of a timing controller.

In an exemplary embodiment, the amplifier may be a non-inverting amplifier.

In an exemplary embodiment, the transistor may be a NPN transistor.

In an exemplary embodiment, the transistor may be a NMOS transistor.

According to an exemplary embodiment of the invention, there is provided a display apparatus. The display apparatus includes a display panel comprising a plurality of data lines, a plurality of gate lines and a plurality of pixels, a panel driving part comprising a plurality of driver circuits which is configured to drive the display panel, and a voltage generating part comprising a voltage dividing part which is connected between a main voltage source and a ground, the voltage dividing part being configured to generate into a plurality of driving voltages utilizing a main voltage, a delay part which is connected between a driving voltage source and the ground, the delay part being configured to delay a driving voltage by a predetermined period and apply the driving voltage to an input terminal of a driver circuit, and a discharge part which is connected between the voltage dividing part and the delay part, the discharge part being configured to discharge a voltage charged in the delay part to a ground when the driving voltage is blocked. The discharge part may include an amplifier, an inverting input of the amplifier being connected to the driving voltage source and a non-inverting input of the amplifier being connected to an output terminal of the delay part.

In an exemplary embodiment, the discharge part may a transistor which comprises a control electrode connected to an output terminal configured to output an output signal of the amplifier, a first electrode connected to the output terminal of the delay part and a second electrode connected to the ground.

In an exemplary embodiment, the amplifier may be a non-inverting amplifier.

In an exemplary embodiment, the transistor may be a NPN transistor.

In an exemplary embodiment, the transistor may be a NMOS transistor.

In an exemplary embodiment, the driver circuits may include a data driver part configured to drive the data lines, a gate driver part configured to drive the gate lines, and a timing control part configured to control a driving timing of the data driver part and the gate driver part.

In an exemplary embodiment, the delay part may be configured to delay a driving voltage of the timing control part and to provide a reset terminal of the timing control part with delayed driving voltage.

In an exemplary embodiment, the discharge part may be configured to discharge a voltage applied to an output terminal of the delay part to the ground when the main voltage is blocked.

In an exemplary embodiment, the amplifier may be driven by a remaining voltage which is dropped from the main voltage, when the main voltage is blocked.

According to the inventive concept, when the main voltage is blocked, the voltage charged in the capacitor of the delay part may be discharged quickly. In addition, the abnormal signal charged in the capacitor may be discharged quickly. Therefore, a driving reliability of the display apparatus may be improved.

BRIEF DESCRIPTION OF THE DRAWINGS

The above and other features and advantages of the inventive concept will be more apparent by detailed exemplary embodiments thereof with reference to the accompanying drawings, in which.

DETAILED DESCRIPTION OF THE INVENTION

Hereinafter, the inventive concept will be explained in detail with reference to the accompanying drawings.

Figure 1:
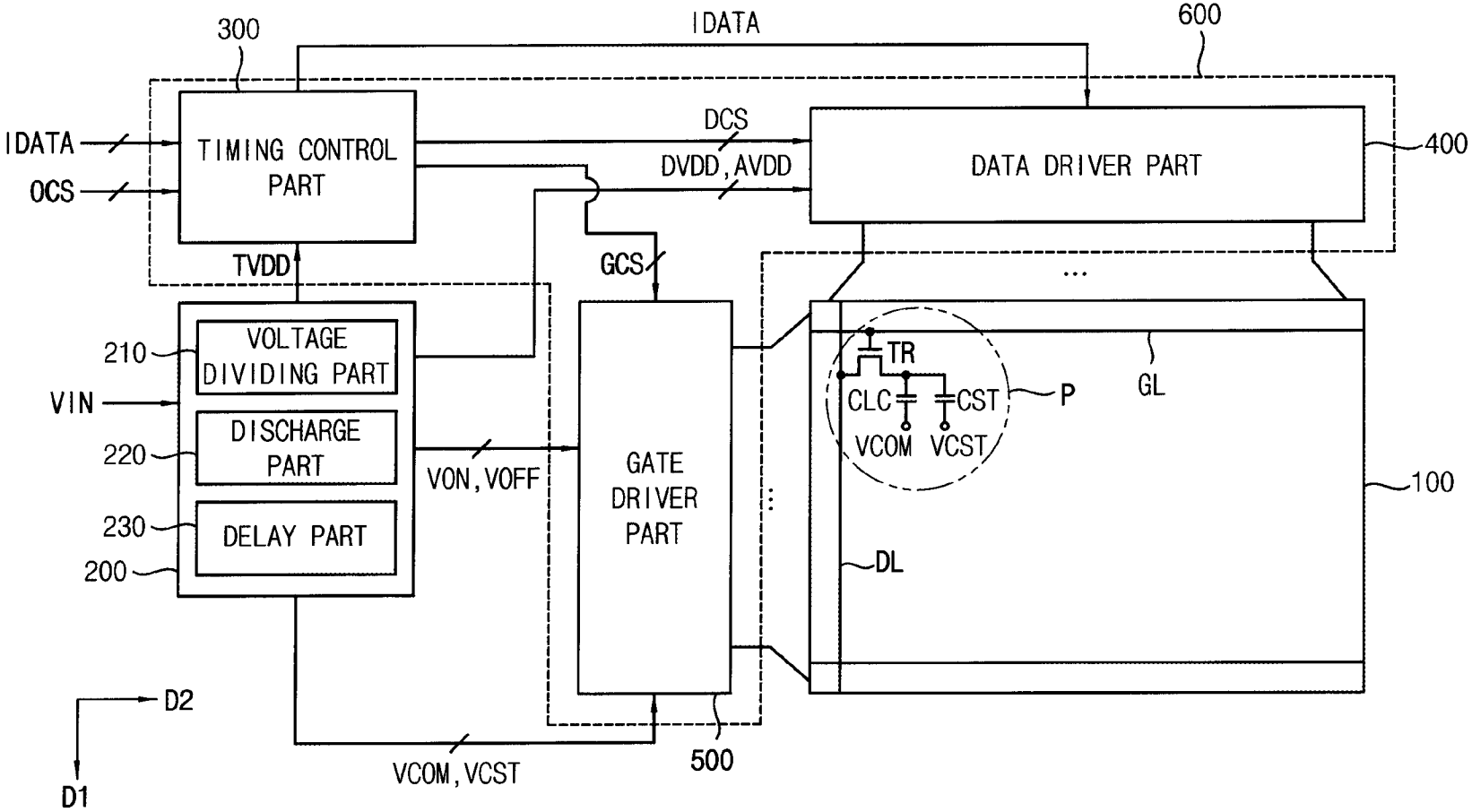
FIG. 1 is a block diagram illustrating a display apparatus according to an exemplary embodiment.

FIG. 1 is a block diagram illustrating a display apparatus according to an exemplary embodiment.

Referring to FIG. 1, the display apparatus may include a display panel 100, a voltage generating circuit 200 and a panel driving part 600. The panel driving part 600 may include a plurality of driver circuits, and the driver circuits may include a timing control part 300, a data driver part 400 and a gate driver part 500.

The display panel 100 may include a plurality of data lines DL, a plurality of gate lines GL and a plurality of pixels P.

The data lines DL extend in a first direction D1 and are arranged in a second direction D2 crossing the first direction D1.

The gate lines GL extend in the second direction D2 and are arranged in the first direction D1.

The pixels P are arranged in a matrix configuration which includes a plurality of pixel columns and a plurality of pixel rows. A pixel column may include pixels arranged in the first direction D1 and a pixel row may include pixels arranged in the second direction D2.

Each of pixels P may include a switching element TR, a liquid crystal capacitor CLC and a storage capacitor CST. The switching element TR is connected to a gate line GL, a data line DL and the liquid crystal capacitor CLC. The storage capacitor CST is connected to the liquid crystal capacitor CLC. A liquid crystal ("LC") common voltage VCOM is applied to a first end portion of the liquid crystal capacitor CLC and a storage common voltage VCST is applied to the storage capacitor CST. The LC common voltage VCOM may have a voltage level equal to that of the storage common voltage VCST.

The voltage generating circuit 200 is configured to generate a plurality of driving voltages to drive a plurality of driver circuits of the display apparatus. The voltage generating circuit 200 may include a voltage dividing part 210, a delay part 230 and a discharge part 220. The plurality of driver circuits may include the display panel 100, the timing control part 300, the data driver part 400 and the gate driver part 500.

The voltage dividing part 210 is configured to divide a main voltage VIN received from an external system into a plurality of driving voltages and to output the driving voltages. For example, the driving voltages may include a first driving voltage TVDD to drive the timing control part 300, second driving voltages AVDD and DVDD to drive the data driver part 400, third driving voltages VON and VOFF to drive the gate driver part 500 and fourth driving voltage VCOM and VCST to drive the display panel 100.

The discharge part 220 may be connected to at least one of a plurality of output terminals of the voltage dividing part 210. The discharge part 220 discharges a voltage applied to an output terminal of the voltage dividing part 210 to a ground when the main voltage VIN is blocked.

The delay part 230 is connected between the output terminal of the voltage dividing part 210 and an input terminal of a driver circuit receiving the driving voltage from the output terminal. The delay part 230 is configured to delay the driving voltage and to provide delayed driving voltage to the driver circuit.

In an exemplary embodiment, when the driving voltage is changed from a low level to a high level, the transistor 222 in the discharge part 220 is turned off and the driving voltage which is delayed by a predetermined period through the delay part 230 is applied to the input terminal of the driver circuit, for example, a reset terminal REST of the timing control circuit 300. However, when the driving voltage is changed from the high level to the low level, the transistor 222 in the discharge part 220 is turned on and the voltage which is applied to the delay part 230 is discharged to a lower level, for example, the ground. The voltage applied to the delay part 230 may be a voltage charged in a capacitor of the delay part 230. Thus, the driving voltage is blocked form being applied to the input terminal of the driver circuit.

In addition, in a condition in which the main voltage VIN is blocked form being applied to the voltage generating circuit 200, that is, the driving voltage is at the low level, if an abnormal signal such as an electrostatic charge is applied to the delay part 230, the electrostatic charge is blocked from being applied to the input terminal of the driver circuit by the discharge part 220 which discharges the electrostatic charge by turning on the transistor 222. Therefore, the discharge part 220 may prevent the driver circuit from damaging by the electrostatic charge.

The timing control part 300 receives an original control signal OCS and an image data signal IDATA from the external system.

The timing control part 300 is configured to generate a plurality of timing control signals to drive the plurality of driver circuits based on the original control signal OCS which controls a driving timing of the driver circuits. For example, the timing control signals may include a data control signal DCS to control the data driver part 400 and a gate control signal GCS to control the gate driver part 500. The data control signal DCS may include a vertical synchronization signal, a horizontal synchronization signal, a data enable signal, a load signal and so on. The gate control signal GCS may include a vertical start signal and a plurality of clock signals.

The timing control part 300 is configured to correct the image data signal IDATA using various compensation algorithms and is configured to provide the data driving part 400 with corrected image data signal. The compensation algorithms may include for improving a response time and a color reproduction.

The data driver part 400 is configured to convert the data signal IDATA received from the timing control part 300 into a data voltage using a reference gamma voltage and is configured to provide the data line DL with the data voltage.

The gate driver part 500 is configured to generate a gate signal based on the gate driving voltages VON and VOFF and the gate control signal and is configured to sequentially provide the gate line GL with the gate signal.

Figure 2:
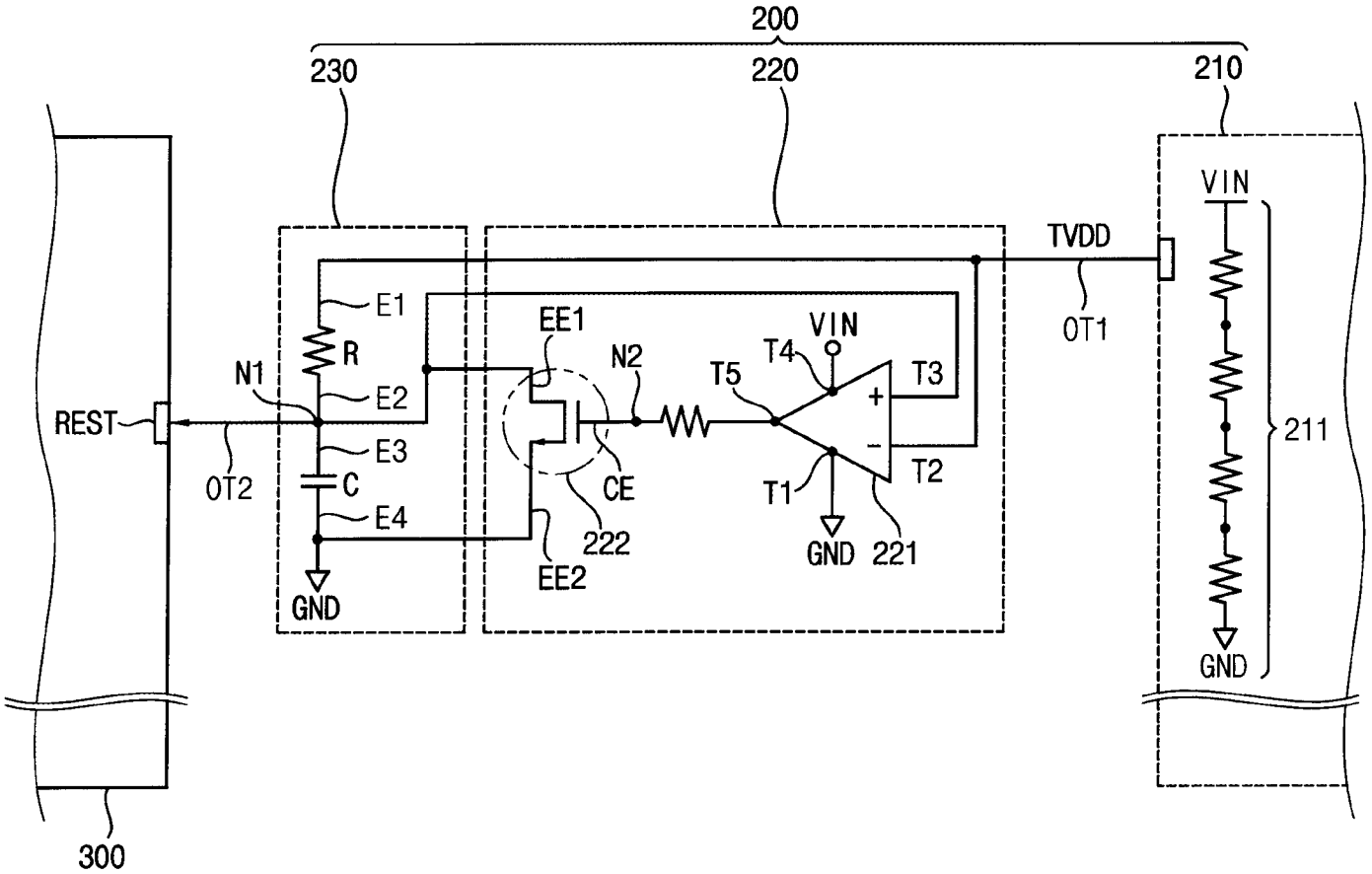
FIG. 2 is a block diagram illustrating a voltage generating circuit of FIG. 1.

FIG. 2 is a block diagram illustrating a voltage generating circuit of FIG. 1.

Referring to FIGS. 1 and 2, the voltage generating circuit 200 may include a voltage dividing part 210, a discharge part 220 and a delay part 230.

The voltage dividing part 210 may include a resistor string 211. The resistor string 211 is connected between the main voltage VIN and a ground GND. The voltage dividing part 210 is configured to divide the main voltage VIN into a plurality of driving voltages through the resistor string 211 and is configured to output the plurality of driving voltages having different levels.

Hereinafter, the voltage generating circuit 200 will be explained referring to a driving voltage TVDD applied to the reset terminal REST of the timing control part 300.

As shown in FIG. 2, a first output terminal OT1 of the voltage dividing part 210 is configured to output the driving voltage TVDD.

The discharge part 220 may include an amplifier 221 and a transistor 222.

The amplifier 221 may be a non-inverting amplifier. The amplifier 221 includes a negative power supply T1, an inverting input T2, a non-inverting input T3, a positive power supply T4 and an output T5. The negative power supply T1 is connected to the ground GND, the inverting input T2 is connected to the first output terminal OT1 of the voltage dividing part 210 and the non-inverting input T3 is connected to a second output terminal OT2 of the delay part 230. The positive power supply T4 is connected to the main voltage VIN and is configured to receive a main voltage VIN, and the output T5 is configured to output an output signal corresponding to a signal applied to the non-inverting input T3. In an exemplary embodiment, the amplifier 221 outputs a non-inverted signal which has a same phase as the signal applied to the non-inverting input T3 through the output T5. The second output terminal OT2 of the delay part 230 is configured to output a reset voltage to reset the timing control part 300.

The transistor 222 include a control electrode CE which is connected to the output T5 of the amplifier 221 via a resistor, a first electrode EE1 which is connected to the second output terminal OT2 of the delay part 230 and a second electrode EE2 which is connected to the ground GND. The transistor 222 may be a NPN transistor. The transistor 222 may be a NPN bipolar transistor.

The delay part 230 may include a resistor R and a capacitor C which is serially connected to the resistor R. For example, the delay part 230 may have a RC time constant corresponding to a driving sequence of the driver circuits. The resistor R includes a first end portion E1 which is connected to the first output terminal OT1 of the voltage dividing part 210 and a second end portion E2 which is connected to the second output terminal OT2 of the delay part 230. The capacitor C includes a first end portion E3 which is connected to the second output terminal OT2 of the delay part 230 and a second end portion E4 which is connected to the ground GND. The second output terminal OT2 of the delay part 230 is connected to a reset terminal REST of the timing control part 300.

A first output node N1 is connected to the second output terminal OT2 of the delay part 230, the second end portion E2 of the resistor R, a first end portion E3 of the capacitor C and the first electrode EE1 of the transistor 222. The second output node N2 is connected to the output T5 of the amplifier 221 and the control electrode CE of the transistor 222.

Figure 3A:
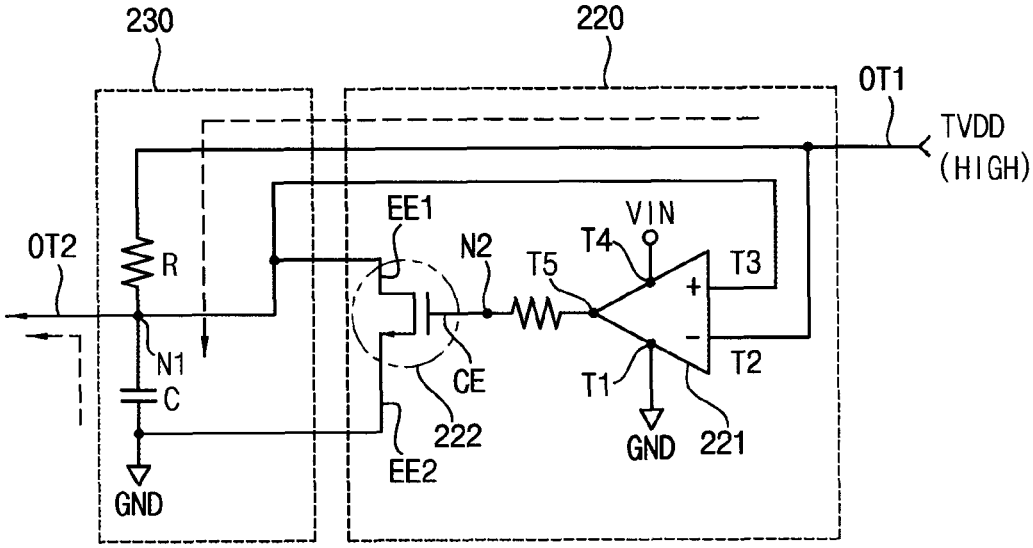
FIGS. 3A and 3B are conceptual diagrams illustrating a method of driving the voltage generating circuit of FIG. 2.
Figure 3B:
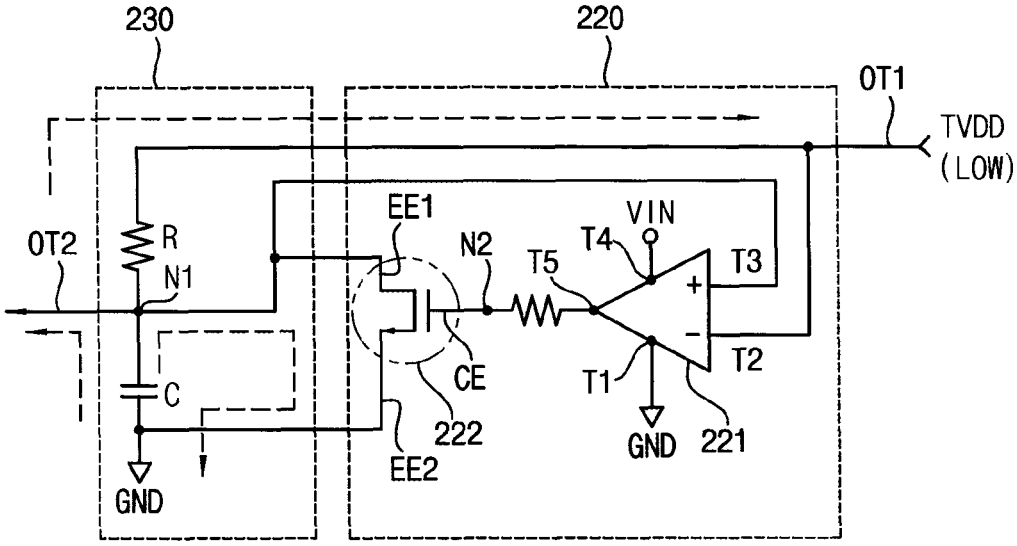

FIGS. 3A and 3B are conceptual diagrams illustrating a method of driving the voltage generating circuit of FIG. 2.

Referring to FIGS. 2 and 3A, in a condition in which the voltage generating circuit 200 is turned off, when the main voltage VIN is initially applied from the external system, the voltage generating circuit 200 receives the main voltage VIN.

The voltage dividing part 210 divides the main voltage VIN such that the driving voltages for driving the driver circuits of the display apparatus are generated.

For example, the voltage dividing part 210 outputs the driving voltage TVDD of the high level to drive the timing control part 300.

The discharge part 220 receives the driving voltage TVDD of the high level. The inverting input T2 of the amplifier 221 receives the driving voltage TVDD of the high level, and the non-inverting input T3 of the amplifier 221 receives a signal of the low level. The voltage generating circuit 200 is in a turn-off state before being received the main voltage VIN such that the reset terminal REST of the timing control part 300 initially has a low level. Thus, the non-inverting input T3 of the amplifier 221 receives the signal of the low level. The amplifier 221 is operated as the non-inverting amplifier such that an output signal has the low level, that is, a same phase as the low level of the signal applied to the non-inverting input T3.

The second output node N2 receives the output signal of the low level. The control electrode CE of the transistor 222 which is connected to the second output node N2 receives the output signal of the low level such that the transistor 222 is turned off in response to the output signal of the low level. Thus, the discharge part 220 is in a turn-off state.

The delay part 230 receives the driving voltage TVDD of the high level. The driving voltage TVDD of the high level is delayed by the predetermined period corresponding to the RC time constant of the delay part 230, and then is applied to a reset terminal REST of the timing control part 300 through the second output terminal OT2. Thus, the reset terminal REST receives the reset voltage of the high level. The timing control part 300 is reset in response to the reset voltage of the high level received from the reset terminal REST.

Referring to FIGS. 2 and 3B, in a condition in which the voltage generating circuit 200 is turned off, when the main voltage VIN is blocked from the external system, the voltage generating circuit 200 does not receive the main voltage VIN.

The voltage dividing part 210 does not output the driving voltage TVDD.

Therefore, the discharge part 220 receives the signal of the low level. That is, the inverting input T2 of the amplifier 221 receives the signal of the low level and the non-inverting input T3 of the amplifier 221 receives the signal of the high level. The voltage generating circuit 200 is in a turn-on state before being blocked the main voltage VIN such that the reset terminal REST of the timing control part 300 has the high level. Thus, the non-inverting input T3 of the amplifier 221 receives the signal of the high level. The amplifier 221 is operated as the non-inverting amplifier, and thus outputs an output signal which has the high level, that is, a same phase as the high level of the signal applied to the non-inverting input T3.

The second output node N2 receives the output signal of the high level. The control electrode CE of the transistor 222 which is connected the second output node N2 receives the output signal of the high level such that the transistor 222 is turned on in response to the output signal of the high level. Thus, the transistor 222 discharges the signal of the high level applied to the first electrode EE1 to the ground connected to the second electrode EE2. Therefore, a voltage charged in the capacitor C of the delay part 230 may be discharged to the ground through the transistor 222 quickly.

In addition, the voltage charged in the capacitor C may be discharged to the reset terminal REST of the timing control part 300 and the first output terminal OT1 of the voltage dividing part 210.

In an exemplary embodiment, when the main voltage VIN is blocked, a voltage charged in the capacitor C may be discharged through the transistor 222 as well as the reset terminal REST of the timing control part 300 and the first output terminal OT1 of the voltage dividing part 210. As described above, the voltage charged in the capacitor C may be discharged through a plurality of discharge passes such that a discharge time may be decreased. Therefore, the voltage of the reset terminal REST may be quickly discharged to a predetermined voltage, for example, to a ground GND and then, the timing control part 300 may be normally driven.

In general, the main voltage VIN received from the external system has a high level and is stabilized by a stabilization circuit which includes a plurality of capacitors. When the main voltage VIN is blocked, a falling time of the main voltage VIN during which the main voltage VIN falls from the high level to the low level becomes long due to the stabilization circuit. Thus, the amplifier 221 may be sufficiently driven by a remaining voltage which is lower than the main voltage. As explained above, even when the main voltage VIN is blocked, the discharge part 220 may be normally driven.

In addition, in an exemplary embodiment, in the turn-off state of the voltage generating circuit 220, the discharge part 220 may discharge the abnormal signal such as the electrostatic charge or a peak voltage of various signals charged in the capacitor C.

For example, when the voltage generating circuit 220 is in the turn-off state while the main voltage VIN is applied to the display apparatus, a method of discharging the abnormal signal charged in the capacitor C will be explained below.

The voltage generating circuit 220 is in the turn-off state, and thus the inverting input T2 of the amplifier 221 receives the signal of the low level and the non-inverting input T3 of the amplifier 221 receives the signal of the high level by the voltage charged in the capacitor C.

The amplifier 221 is driven as the non-inverting amplifier, and thus outputs the signal of the high level which has a same phase as the high level of the signal applied to the non-inverting input T3.

The second output node N2 receives an output signal of the high level. The control electrode CE of the transistor 222 which is connected to the second output node N2 receives the output signal of the high level such that the transistor 222 is turned on in response to the output signal of the high level. The transistor 222 is turned on, and thus the signal of the high level which is applied to the first electrode EE1 is discharged to the ground which is connected to the second electrode EE2. As described above, the voltage charged in the capacitor C of the delay part 230 may be discharged to the ground through the transistor 222.

In addition, the voltage charged in the capacitor C may be discharged to the reset terminal REST of the timing control part 300 and the first output terminal OT1 of the voltage dividing part 210.

According to an exemplary embodiment, a false operation of the driver circuit may be prevented by the abnormal signal. For example, when the abnormal signal is charged in the capacitor C, an operation of the driver circuit may be different from the operation sequence as intended. In this case, the discharge part 220 according to an exemplary embodiment may prevent from the false operation of the driver circuit.

Figure 4:
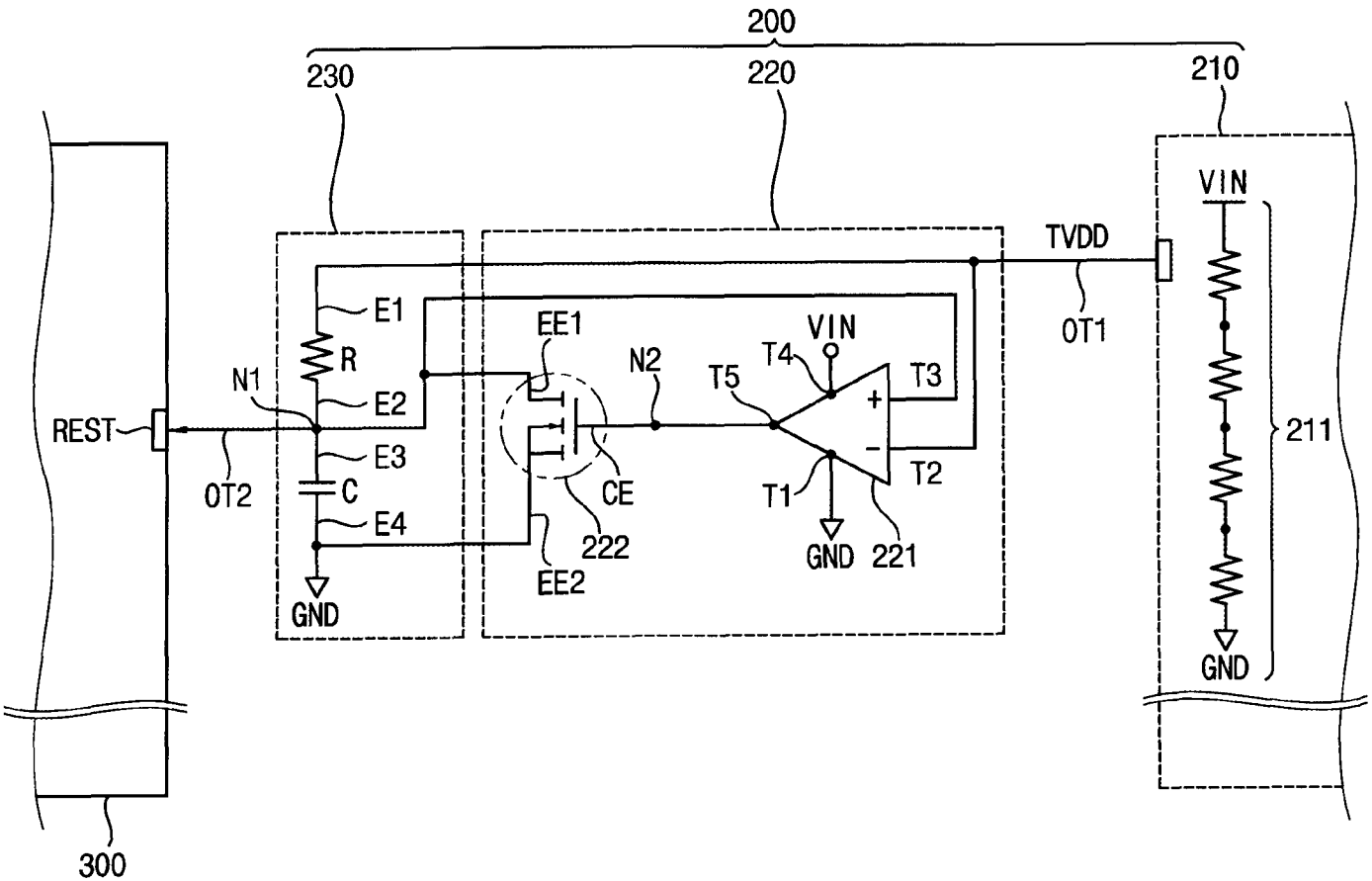
FIG. 4 is a block diagram illustrating a voltage generating circuit according to an exemplary embodiment.

FIG. 4 is a block diagram illustrating a voltage generating circuit according to an exemplary embodiment. Hereinafter, the same reference numerals are used to refer to the same or like parts as those described in the previous exemplary embodiments.

Referring to FIGS. 1 and 4, a voltage generating circuit according to an exemplary embodiment includes the substantially same or like parts as those described in the previous exemplary embodiments except for a transistor.

The voltage generating circuit 200 may include a voltage dividing part 210, a discharge part 220 and a delay part 230.

The voltage dividing part 210 may include a resistor string 211. The voltage dividing part 210 is configured to divide a main voltage VIN received from an external system into a plurality of driving voltages and to output the driving voltages having different levels.

Hereinafter, the voltage generating circuit 200 will be explained referring to a driving voltage TVDD applied to the timing control part 300. As shown in FIG. 4, a first output terminal OT1 of the voltage dividing part 210 is configured to output the driving voltage TVDD.

The discharge part 220 may include an amplifier 221 and a transistor 222.

The amplifier 221 may be a non-inverting amplifier. The amplifier 221 includes a negative power supply T1, an inverting input T2, a non-inverting input T3, a positive power supply T4 and an output T5. The negative power supply T1 is connected to a ground GND, the inverting input T2 is connected to the first output terminal OT1 of the voltage dividing part 210 and the non-inverting input T3 is connected to a second output terminal OT2 of the delay part 230. The positive power supply T4 is configured to receive a main voltage VIN and the output T5 is configured to output an output signal corresponding to a signal applied to the non-inverting input T3. The second output terminal OT2 of the delay part 230 is configured to output a reset voltage for resetting the timing control part 300.

In an exemplary embodiment, the amplifier 221 outputs a non-inverted signal which has a same phase as the signal applied to the non-inverting input T3 through the output T5.

The transistor 222 include a control electrode CE which is connected to the output T5 of the amplifier 221 via resistor, a first electrode EE1 which is connected to the second output terminal OT2 of the delay part 230 and a second electrode EE2 which is connected to the ground GND. The transistor 222 may be a NMOS transistor.

The delay part 230 may include a resistor R and a capacitor C which is connected to the resistor R. For example, the delay part 230 may have a RC time constant corresponding to a driving sequence of the driver circuits. The resistor R includes a first end portion E1 which is connected to the first output terminal OT1 of the voltage dividing part 210 and a second end portion E2 which is connected to the second output terminal OT2 of the delay part 230. The capacitor C includes a first end portion E3 which is connected to the second output terminal OT2 of the delay part 230 and a second end portion E4 which is connected to the ground GND. The second output terminal OT2 of the delay part 230 is connected to a reset terminal REST of the timing control part 300.

A first output node N1 is connected to the second output terminal OT2 of the delay part 230, the second end portion E2 of the resistor R, a first end portion E3 of the capacitor C and the first electrode EE1 of the transistor 222. The second output node N2 is connected to the output T5 of the amplifier 221 and the control electrode CE of the transistor 222.

A method of driving the voltage generating circuit according to an exemplary embodiment may be the substantially same as those described in the previous exemplary embodiment referring to FIGS. 3A and 3B and the same detailed explanations are not repeated unless necessary.

FIGS. 5A to 5D are waveform diagrams illustrating a rising time and falling time of a main voltage and a reset voltage according to an exemplary embodiment and a comparative embodiment.

The voltage generating circuit according to an exemplary embodiment is the same as that shown in FIG. 2 and the voltage generating circuit according to a comparative embodiment omits the discharge part from the voltage generating circuit according to an exemplary embodiment.

TABLE

| | Comparative embodiment | Exemplary embodiment |
|---|---|---|
| Rising Time | 7.1 ms | 6.9 ms |
| Falling Time | 1.2 ms | 0.15 ms |

Figure 5A:
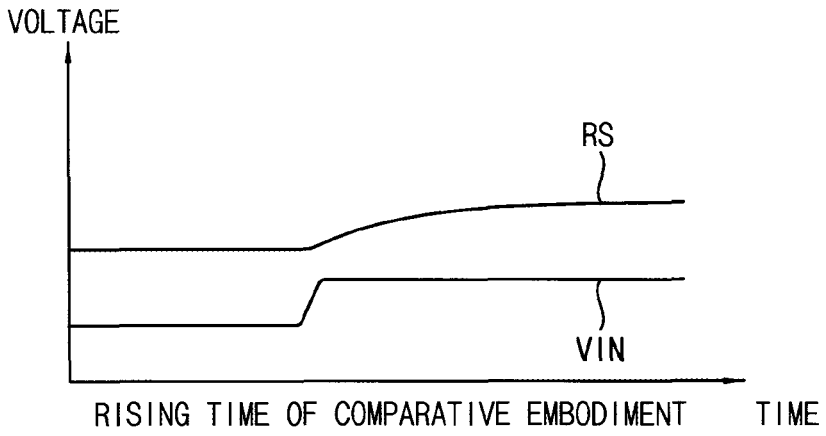
FIGS. 5A to 5D are waveform diagrams illustrating a rising time and falling time of a main voltage and a reset voltage according to an exemplary embodiment and a comparative embodiment.

Referring to Table and FIG. 5A, according to the comparative embodiment, a rising time of the reset voltage RS with respect to that of the main voltage VIN is about 7.1 ms. Referring to Table and FIG. 5C, according to the comparative embodiment, a falling time of the reset voltage RS with respect to that of the main voltage VIN is about 1.2 ms.

Figure 5B:
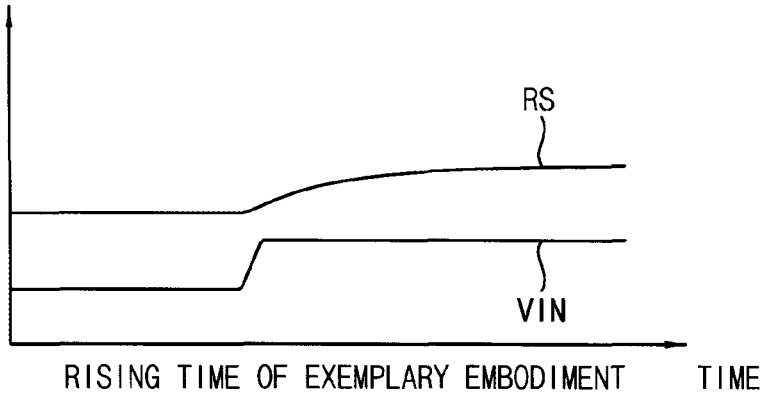
Figure 5C:
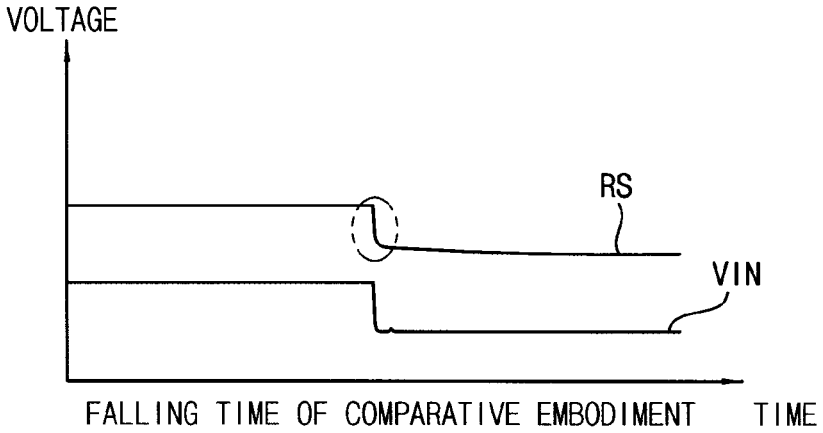
Figure 5D:
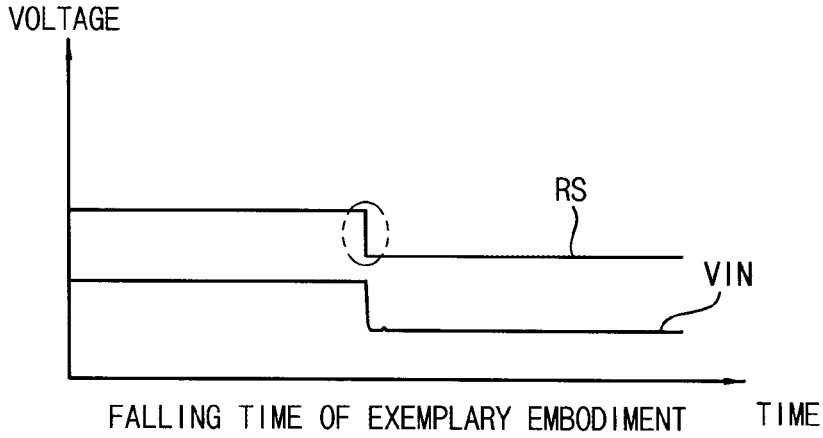

In contrast, referring to Table and FIG. 5B, according to the exemplary embodiment, the rising time of the reset voltage RS with respect to that of the main voltage VIN is about 6.9 ms. Referring to Table and FIG. 5D, according to the exemplary embodiment, a falling time of the reset voltage RS with respect to that of the main voltage VIN is about 0.15 ms.

As described above, the rising time of the reset voltage RS according to the exemplary embodiment may be similar to the rising time of the reset voltage RS according to the comparative embodiment. However, the falling time of the reset voltage RS according to the exemplary embodiment may be reduced tenfold than the falling time of the reset voltage RS according to the comparative embodiment.

As described above, the driver circuit is referred to as the timing control part but the driver circuit may correspond to all driver circuits applied to the driving voltages which are generated from the voltage generating circuit. In addition, the discharge part may be connected to various terminals of the driver circuit which is required to quickly discharge as well as the reset terminal.

According to exemplary embodiments of the invention, when the main voltage is blocked, the voltage charged in the capacitor of the delay part may be discharged quickly. In addition, the abnormal signal charged in the capacitor may be discharged quickly. Therefore, a driving reliability of the display apparatus may be improved.

The foregoing is illustrative of the inventive concept and is not to be construed as limiting the scope of the inventive concept. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A voltage generating circuit comprising:

a voltage dividing part connected between a main voltage source and a ground, and configured to divide a main voltage into a plurality of driving voltages and output the plurality of driving voltages;

a delay part connected between a driving voltage source and the ground, and configured to delay a driving voltage by a predetermined period and apply the driving voltage to an input terminal of a driver circuit; and a discharge part connected between the voltage dividing part and the delay part, and configured to discharge a voltage charged in the delay part to a ground when the driving voltage is blocked, wherein the discharge part comprises an amplifier, an inverting input of the amplifier being connected to the driving voltage source and a non-inverting input of the amplifier being connected to an output terminal of the delay part and a reset terminal of a timing controller.

2. The voltage generating circuit of claim 1, wherein the discharge part further comprises:

a transistor which comprises a control electrode connected to an output terminal of the amplifier to output an output signal of the amplifier, a first electrode connected to the output terminal of the delay part and a second electrode connected to the ground.

3. The voltage generating circuit of claim 2, wherein the discharge part further comprises:

a resistor connected between the output terminal of the amplifier and the control terminal of the transistor.

4. The voltage generating circuit of claim 3, wherein the output terminal of the delay part is connected to the reset terminal of the timing controller.

5. The voltage generating circuit of claim 2, wherein the output terminal of the delay part is connected the reset terminal of the timing controller.

6. The voltage generating circuit of claim 2, wherein the amplifier is a non-inverting amplifier.

7. The voltage generating circuit of claim 2, wherein the transistor is a NPN transistor.

8. The voltage generating circuit of claim 2, wherein the transistor is a NMOS transistor.

9. A display apparatus comprising:

a display panel comprising a plurality of data lines, a plurality of gate lines and a plurality of pixels;

a panel driving part comprising a plurality of driver circuits which is configured to drive the display panel; and a voltage generating part comprising a voltage dividing part which is connected between a main voltage source and a ground, the voltage dividing part being configured to generate a plurality of driving voltages utilizing a main voltage, a delay part which is connected between a driving voltage source and the ground, the delay part being configured to delay a driving voltage by a predetermined period and apply the driving voltage to an input terminal of a driver circuit, and a discharge part which is connected between the voltage dividing part and the delay part, the discharge part being configured to discharge a voltage charged in the delay part to a ground when the driving voltage is blocked, wherein the discharge part comprises an amplifier, an inverting input of the amplifier being connected to the driving voltage source and a non-inverting input of the amplifier being connected to an output terminal of the delay part and a reset terminal of a timing controller.

10. The display apparatus of claim 9, wherein the discharge part comprises:

a transistor which comprises a control electrode connected to an output terminal to output an output signal of the amplifier, a first electrode connected to the output terminal of the delay part and a second electrode connected to the ground.

11. The voltage generating circuit of claim 10, wherein the discharge part further comprises:

a resistor connected between the output terminal of the amplifier and the control terminal of the transistor.

12. The voltage generating circuit of claim 11, wherein the output terminal of the delay part is connected to the reset terminal of the timing controller.

13. The voltage generating circuit of claim 10, wherein the output terminal of the delay part is connected to the reset terminal of the timing controller.

14. The display apparatus of claim 10, wherein the amplifier is a non-inverting amplifier.

15. The display apparatus of claim 10, wherein the transistor is a NPN transistor.

16. The display apparatus of claim 10, wherein the transistor is a NMOS transistor.

17. The display apparatus of claim 10, wherein the driver circuits comprise:

a data driver part configured to drive the data lines;

a gate driver part configured to drive the gate lines; and a timing control part configured to control a driving timing of the data driver part and the gate driver part.

18. The display apparatus of claim 17, wherein the delay part is configured to delay a driving voltage of the timing control part and to provide a reset terminal of the timing control part with delayed driving voltage.

19. The display apparatus of claim 17, wherein the discharge part is configured to discharge a voltage applied to an output terminal of the delay part to the ground when the main voltage is blocked.

20. The display apparatus of claim 19, wherein the amplifier is driven by a remaining voltage which is dropped from the main voltage, when the main voltage is blocked.

* * * * *